US005697336A

United States Patent [19]

Eisenbacher et al.

[11] Patent Number: 5,697,336

[45] Date of Patent: Dec. 16, 1997

[54] ENGINE BRAKE FOR A MULTI-CYLINDER INTERNAL COMBUSTION ENGINE

[75] Inventors: Egon Eisenbacher, Karlstadt am Main; Frank Pawellek, Hafenlohr; Manfred Unger, Kleinostheim, all of Germany

[73] Assignee: Mannesmann Rexroth GmbH, Lohr/Main, Germany

[21] Appl. No.: 727,442

[22] PCT Filed: Apr. 25, 1995

[86] PCT No.: PCT/EP95/01557

§ 371 Date: Oct. 18, 1996

§ 102(e) Date: Oct. 18, 1996

[87] PCT Pub. No.: WO95/29324

PCT Pub. Date: Nov. 2, 1995

[30] Foreign Application Priority Data

Apr. 26, 1994 [DE] Germany ..... 44 14 400.8

[51] Int. Cl.[6] ..... F01L 13/06

[52] U.S. Cl. ..... 123/324; 123/321

[58] Field of Search ..... 123/321, 322, 123/324

[56] References Cited

U.S. PATENT DOCUMENTS 5,257,605 11/1993 Pawellek et al. ..... 123/321

FOREIGN PATENT DOCUMENTS 0337439 10/1989 European Pat. Off. .

2357754 2/1978 France .

2381173 9/1978 France .

4038334 11/1991 Germany .

4121435 1/1993 Germany .

9113010 2/1993 Germany .

4126640 3/1993 Germany .

4138447 5/1993 Germany .

661652 11/1951 United Kingdom .

*Primary Examiner*—Andrew M. Dolinar

*Attorney, Agent, or Firm*—Martin A. Farber

[57] ABSTRACT

The present invention proceeds from an engine brake for a multi-cylinder internal combustion engine with decompression valves actuatable by pressurization of hydraulic pistons outside of the exhaust stroke of the working piston of the internal combustion engine, in particular at the end of the compression stroke. A radial piston pump is provided with internally supported radial pistons. The pump housing has a first housing section with the radial pistons, and a space for the eccentric which controls the radial pistons and a second housing section with the control outputs. Two distributor disks of the distributor unit are displaceably sealed off axially with respect to each other, the first distributor disk which separates a first pressure zone within the first housing section and a second pressure zone between the two housing sections from each other being adapted to be pressed axially against the first housing section and the second distributor disk which connects a control output in each case only with one pressure zone being adapted to be pressed axially against the second housing section.

23 Claims, 6 Drawing Sheets

13
45
50
11
10
52
51
26
25
18
20
19
90
44
46
63
23
31
95
72
78
64
22
30
29
92
94
93
79
85
37
47
17
27
28
86
96
91
40
39
65
84
61
67
87
36
59
42
38
62
81
69
77
68
43
24
16
49
64
80
71
83
82
70
14
12
15
41
48
66
60
21

ENGINE BRAKE FOR A MULTI-CYLINDER INTERNAL COMBUSTION ENGINE

FIELD AND BACKGROUND OF THE INVENTION

The present invention is based on an engine brake intended for a multi-cylinder internal combustion engine in which, outside the exhaust stroke of a working piston, in particular at the end of the compression stroke, a decompression valve can be actuated by pressurization of hydraulic cylinders, and which has the features set forth in the preamble to claim 1.

Such an engine brake is known from Federal Republic of Germany 41 38 447 A1. The radial piston pump used there as source of pressurizing agent has a rotor which can be driven by the internal combustion engine and within which several radial pistons are arranged, guided radially. Each radial piston rests radially on the outside on an eccentric element, fixed on the housing, having a cam curve by which a forward and backward representation is impressed on it when the rotor rotates. Within the housing of the known pump for an engine brake, a distributor unit attached, fixed for rotation, to the rotor is arranged in the form of a single distributor disk. For the pressurization and depressurization of the hydraulic pistons of the decompression valves the pump has control outputs which lie axially opposite the distributor disk and are connected alternately via it with a high-pressure zone and a low-pressure zone of the pump when the rotor rotates. The known engine brake also includes a valve via which the high-pressure zone, when braking is not effected, can be connected directly to the low-pressure zone of the pump so that no high pressure builds up. The pump is then merely entrained by the internal combustion engine, in which connection, however, the entraining power is more than the amount desired because of the externally supported radial pistons and because of the size and the weight of the rotor. Furthermore, the rotor is of rather complicated construction and accordingly expensive to manufacture.

SUMMARY OF THE INVENTION

The object of the present invention is therefore further to develop the radial piston pump of an engine brake having the features set forth in the preamble to claim 1 in such a manner that, outside of braking operation, it requires only a slight entrainment power and that it can be manufactured at a more favorable cost.

This object is obtained in accordance with the invention for an engine brake which has the features set forth in the preamble of claim 1 in the manner that said engine brake also has the remaining features set forth in claim 1. In the case of such an engine brake, therefore, the radial pistons of the pump are internally supported so that, due to the smaller lever arm, the moment of resistance produced by the frictional force and thus the necessary entrainment power are only slight, even in the case of a mere sliding motion between the eccentric element and the radial piston. The rotor is reduced to the drive shaft and the eccentric moved by it and is therefore very simple to manufacture. The pressurized fluid is not to be transferred either in low pressure or in high pressure into or out of the rotor. The pump housing has a first housing section with said at least one radial piston and a space for the eccentric, and a second housing section having the control outputs. The reverse supporting of the radial pistons and the possibility inherent therein of simplifying the rotor and reducing the entrainment power is obtained in the manner that the distributor unit now has two sealed distributor disks which are displaceable axially with respect to each other. A first one of these two distributor disks can be pressed against the first housing section and thereby separates a first pressure zone within the first housing section from a second pressure zone between the two housing sections from each other. The second distributor disk can be pressed axially against the second housing section and connects a control output in this second housing section in each case to only one of the two pressure zones. In this connection, of course, it also separates the two pressure zones from each other. The distributor disks may possibly also be adapted to be pressed only indirectly against the housing sections in the manner that a part held on the housing section, for instance another disk or a ring, is present between a distributor disk and the corresponding housing section, in order, in particular, to obtain a favorable pairing of materials.

It is particularly advantageous in the case of a radial piston pump with internally supported radial pistons if, in accordance with claim 3, the pressure zone within the first housing section is the low-pressure zone and the pressure zone between the two housing sections is the high-pressure zone. This is favorable, in particular, since the passage of the drive shaft through the pump house can then be sealed off without great difficulty, and because pressure and suction valves can easily be associated in space with the different pressure zones. In order to be able to perform their sealing function, tolerances in the axial distance of the two housing sections from each other and wear are taken up by the distributor disks. For this purpose, the two distributor disks are displaceable sealed off axially with respect to each other. Sealed off means, in this connection, that the high-pressure zone and the low-pressure zone are not connected with each other by slots between the disks. The tight application against the housing sections and the seal between the distributor disks is advisedly obtained, in accordance with claim 4, in the manner that the two distributor disks are guided telescopically within one another or in a third part and that a radial packing ring is arranged between two parts which are guided telescopically one within the other.

When the engine brake is not in operation, the same pressure prevails in the low-pressure zone and the high-pressure zone, and a firm application of the distributor disks against the corresponding housing section is not necessary, and is even disadvantageous since power would be lost and increased wear would result. In brake operation on the other hand, the distributor disks should rest tightly against the housing sections. Both are obtained in a simple manner in accordance with claim 6 by the fact that the distributor disks are pressed by the high pressure hydraulically apart towards the first housing section and the second housing section respectively. In brake operation, high pressure prevails in the one pressure zone and the distributor disks are pressed with great force against the housing sections. In normal operation, the high pressure is absent and therefore also the corresponding force. In order that the distributor disks assume a defined position on the corresponding housing section even in normal operation and that the pressure surfaces which are to be acted on by the high pressure already are at a slight distance from each other so as to allow the high pressure to act, at least one spring element is arranged, in accordance with claim 9, between the two distributor disks, pressing them axially apart. Several spring elements at the same angular distances from each other are preferably present.

In order to open a decompression valve, the corresponding control line is connected via the second distributor disk with the high-pressure zone. For the closing of it, a connection with the low-pressure zone is again brought about. For this control, the second distributor disk has in its face side facing the control outputs a low-pressure control groove which is connected with the los pressure zone and a high pressure control groove which is connected with the high-pressure zone. In order that the second distributor disk does not lift off from the second housing section in the vicinity of the high pressure control groove and allow pressurized fluid to flow directly from the high-pressure zone to the low-pressure zone, a pressure field which can be acted on by high pressure is present, in accordance with claim 10, in the region axially behind the high pressure control groove on the other side of the second distributor disk. If the pressure field is acted on with high pressure, this also has an effect on the first distributor disk unless the force of reaction is transmitted to the first housing section, by passing the first distributor disk. For simple design, it appears desirable in any event to conduct the force of reaction over the first distributor disk to the first housing section. In order that the first distributor disk is not now pressed to an increased extent against the first housing section in the region of the pressure field, the action on the first distributor disk can be compensated for in accordance with claim 12 by the pressure field on the face of this distributor disk facing the first housing section. For this purpose, a pocket which is connected with the high-pressure zone is provided there.

In accordance with claim 13, a cavity is present on the face of the second distributor disk facing the control outputs, said cavity being connected with the first pressure zone within the first housing section. It is possible to effect this connection via channels in the drive shaft. However, it appears simpler if, in accordance with claim 13, the cavity and the first pressure zone are connected to each other via in each case at least one passage in each distributor disk. If, in accordance with claim 14, a spring element which presses the two distributor disks apart is contained in a blind hole in a distributor disk, then the connection between the cavity in the second distributor disk and the first pressure zone can advantageously pass through this blind hole in the manner that the bottom of the blind hole is provided with an opening. The blind hole and the opening can be produced in a single operation.

As pressurized fluid for the actuating of the decompression valves use can be made of the lubricating oil of the internal combustion engine which is pumped by a lubricating oil pump in different oil circuits, including also to the pump of the engine brake. A low pressure of, for instance, 1.5 bar can be established by a pressure control valve in the low-pressure zone of the pump. The low pressure feed channel can, as such, pass through the first housing section into the low-pressure zone present within this housing section. Since the second housing section must, in any event, be accessible from the outside because of the control lines connected to the control outputs, and therefore the pump is to be mounted accordingly on the internal combustion engine, it appears, however, more favorable if the low pressure feed channel pass through the second housing section in accordance with claim 15. Said channel is so arranged that it debouches into the cavity connected with the first pressure zone on the side of the second distributor disk facing the control outputs so that pressurized fluid can pass from the feed channel into the low-pressure zone within the first housing section.

In accordance with claim 16, the distributor disks are made of a steel, and are provided with a slide coating at least on the sections of the surface by which they rest against the housing section. Without an additional coating, good wear behavior is obtained by a development in accordance with claim 17.

Claim 20 refers to the fact that a feather key by which the distributor unit is fastened, fixed against rotation, to the shaft and at the same time also axially secures a stop disk of an eccentric ring.

Claim 21 sets forth an advantageous development of the side of the second distributor disk facing the second housing section with respect to how the control outputs can be connected in a simple manner with the low-pressure zone and the high-pressure zone.

Claim 22 indicates a favorable arrangement of the distributor unit in the pump housing.

In accordance with claim 23, the first housing section extends into the second housing section of cup-shaped development, lies with an outer flange on a substantially annular end of the second housing section, and is centered on the second housing section by a centering collar which internally adjoins the outer flange. Furthermore, further inward axially than the centering collar a space is present everywhere between the two housing sections. In this way, a large volume is created in which high pressure prevails during braking operation and which contributes to avoiding large pressure pulsations. The space between the two housing sections therefore acts as volume resonator.

BRIEF DESCRIPTION OF THE DRAWINGS

Various embodiments of an engine brake in accordance with the invention, of which in part only individual components or a portion of which is shown, are shown in the drawings. With the above and other advantages in view, the present invention will become more clearly understood in connection with the detailed description of preferred embodiments, when considered with the accompanying drawings, of which.

DETAILED DESCRIPTION OF THE PREFERRED EMBODIMENTS

Figure 1:
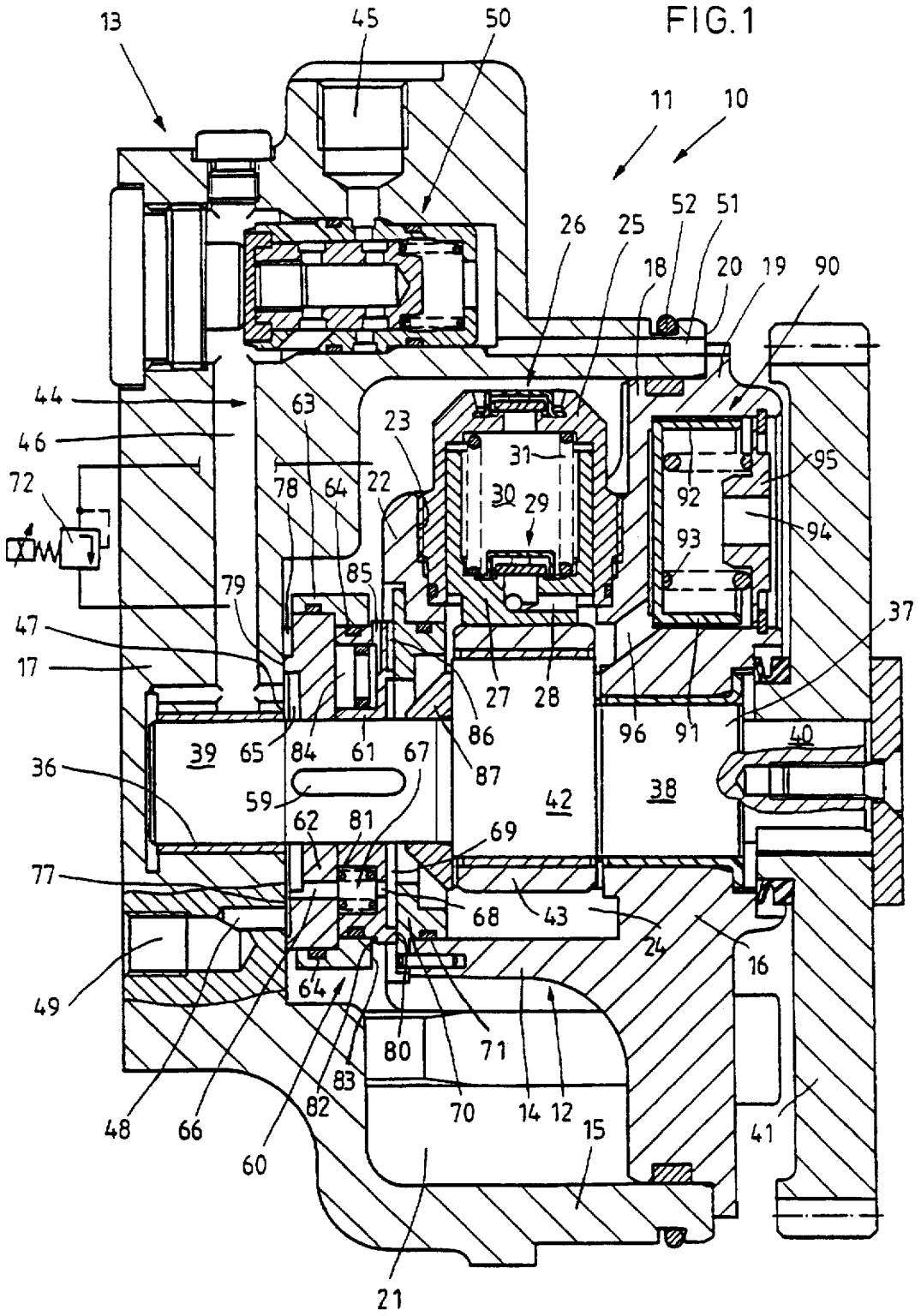
FIG. 1 is a longitudinal section through the first embodiment, in which the distributor unit has two distributor disks which are surrounded by a ring in which they are telescopically guided.
Figure 2:
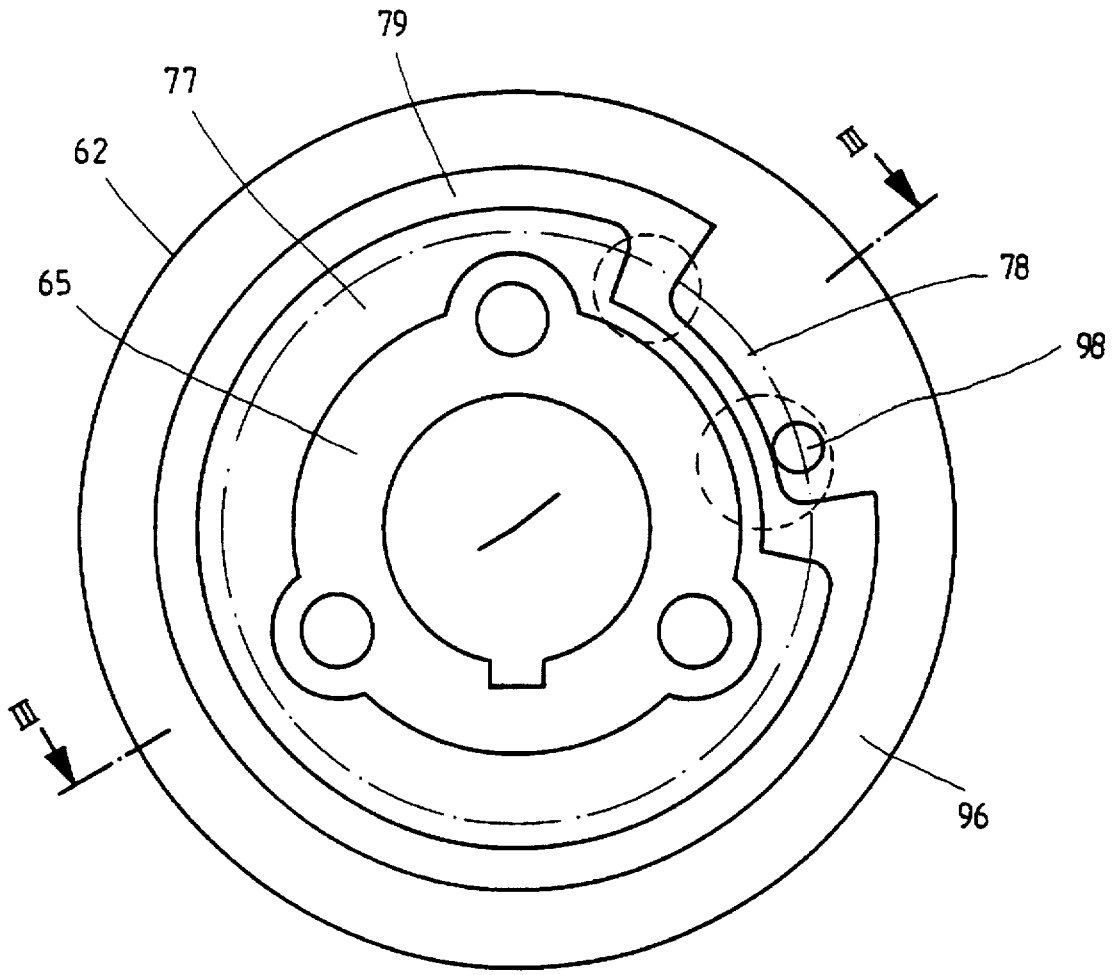
FIG. 2 is a top view of the front side of the second distributor disk facing the control outputs of a second embodiment, in which the two distributor disks are guided telescopically directly one within the other.
Figure 3:
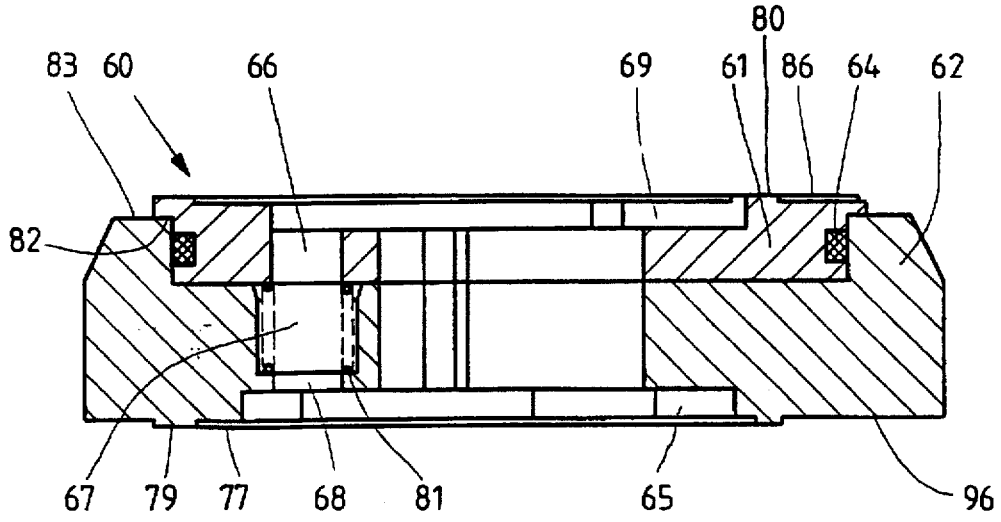
FIG. 3 is a section along the line III—III of FIG. 2.

The radial piston pump 10 according to FIG. 1 belonging to an engine brake has a two-part pump housing 11 with a first housing section 12 and a second housing section 13. Both housing sections are cup-shaped with a cup wall 14 and 15 respectively and a cup bottom 16 and 17 respectively and are inserted in one another in positions opposite each other. The cup wall 14 of the first housing section 12 is substantially smaller in cross section than the hollow space surrounded by the cup wall 15 of the second housing section so that the first housing section 12 fits into the second housing section 13. The cup bottom 16 of the first housing section 12 continues outward in a centering collar 18 over which there radially extends an outer flange 19 by which the first housing section 12 rests centered by the centering point 18 directly adjoining the outer flange 19 in upward direction on the edge 20 of the second housing section 13. Above the centering collar 18 the first housing section 12 is spaced everywhere from and the second housing section 13 and a relatively large intermediate space 21 is present.

At equal angular distance from each other there are developed on the outside of the pot wall 14 of the first housing section 12 a plurality of extensions 22 through which stepped bore holes 23 pass from the outside up into the hollow space 24 surrounded by the cup wall 14 of the first housing section 12. In each hole 23 there is screwed a cylinder housing 25 in the bottom of which there is a pressure valve 26 and which receives a radial piston 27, developed as hollow piston, having a radially inward bottom within which a suction channel 28 debouching into the hollow space 24 extends and on which there is a suction valve 29. A coil compression spring 31 arranged in the displacement space 30 surrounded by the cylinder housing 25 and the radial piston 27 is clamped between the radial piston 27 and the cylinder housing 25 and acts in radially inward direction on the radial piston 27.

A drive shaft 37 of the pump is mounted for rotation by a first bearing section 38 in a continuous bearing hole in the bottom 16 of the first housing section 12 and by a second bearing section 39 in a blind hole 36 in the bottom 17 of the second housing section 13. On a stub shaft 40 which adjoins the first bearing section 38 and protrudes beyond the first housing section 12 there is fastened, fixed for rotation, a gear wheel 41 via which the drive shaft 37 of the internal combustion engine of a motor vehicle can be driven with half the speed of rotation of the internal combustion engine. Within the hollow space 24 the drive shaft 37 has an eccentric 42 on which an eccentric ring 43 is rotatably mounted. The radial pistons 27 are pressed by the compression springs 31 against said eccentric ring 43. When the drive shaft 37 rotates, the radial pistons carry out a backward and forward movement in radial direction under the influence of the eccentric 42, the compression spring 31, and the pressure prevailing in the displacement space 30.

Through the second housing section 13 there extends a low-pressure feed channel 44 in which lubricating oil is pumped as pressurized fluid by a lubricating oil pump, not shown in detail, of a motor vehicle. The feed channel 44 extends from a connection 45 and is formed to the greatest past by a bore hole which extends radially to the drive shaft 37 in the bottom 17 of the second housing section 13 and reaches up to the blind hole which receives the bearing section 39 of the drive shaft 37. The bore hole 46 is traversed by an axial bore hole 47 which is at a slight distance from the blind hole 36 and is open towards the inside in the same manner as the latter. Radially further outwards than the axial bore hole 47 there are present in the bottom 17 of the second housing section 13 further inwardly open axial bore holes 48 all of which are at the same distance from the axis of the blind hole 36 and thus from the drive shaft 37 and have the same angular spacing from each other. The axial bore holes 48 form control outputs of the pump 10 and are connected to control connections 49 to which lines leading to the actuating elements of the decompression valves can be connected. In the feed channel 45 there is installed a pressure-reduction valve 50 which maintains, towards its output and therefore in the bore hole 46, a low feed pressure of for instance 1.5 bar. With pressure peaks exceeding a given value at its output, the pressure-reduction valve returns oil into the oil pan of the internal combustion engine via a bore hole 51 in the cup wall 15 of the second housing section 13. The bore hole 51 passes below a packing 52 inserted in an annular groove on the outside of the cup wall 15 and passes outward at the front side 20 of the cup wall 15. The flange 19 has a small cavity in the region of the bore hole 51 in order not to impede the discharge of oil.

In order to be able to act alternately on the control outputs 18 with the low pressure prevailing at the output of the valve 50 and the high pressure produced by the pump, a distributor unit 60 seated on the output shaft 37 between the eccentric 42 and the bearing section 39 and attached, fixed for rotation, with the output shaft by means of a feather key 59 is present which has a first distributor disk 61, a second distributor disk 62, and a ring 63 which surrounds the two distributor disks in socket-like manner on the outside. The first distributor disk 61 is located close to the first housing section 12 and the second distributor disk 62 is located close to the second housing section 13. The ring 63 has, on its inside, two sections of different diameter between which there is a step facing the second distributor disk 62. The outside diameter of the second distributor disk 62 corresponds to the larger inside diameter of the ring 63. Between the distributor disk 62 and the ring 63 there is a radial packing 64. The distributor disk 61 is provided in the zone of the ring section having the smaller inside diameter with an outside diameter which corresponds to said inside diameter while, closer to the first housing section and outside of the ring 63 it has a larger outside diameter which, however, is still smaller than the outside diameter of the second distributor disk 62. A radial packing 64 is also present between he first distributor disk 61 and the ring 63.

An annular groove 5 of the distributor disk 62 lies opposite the axial bore hole 47, a plurality of bore holes 66 passing axially through the distributor disk 62 extending from its one edge. Each bore hole 66 is arranged coaxial to a blind hole 67 in the distributor disk 61 which hole is open towards the distributor disk 62. Through the bottom of each blind hole 67 there extends a bore hole 68 which debouches into a cavity 69 on the side of the distributor disk 61 facing away from the distributor disk 62. From the cavity 69 there is a connection to the hollow space 64 via a central opening in a ring 70 which reduces the outlet of the hollow space 24. A radial packing 71 is arranged between the ring 70 and the inside of the cup wall 14. Thus oil can pass from the outlet of the pressure-reduction valve 50 via the bore hole 46, the bore hole 47, the annular groove 65, the bore holes 66, 67 and 68, the cavity 69, and the central opening in the support ring 70 into the hollow space 24 of the first housing section 12. From there, the radial pistons 27 draw oil in via the suction channel 28 and the suction valve 29 and force it, via the pressure valve 26, into the space 21 between the first housing section 12 and the second housing section 13. An electromagnetically displaceable pressure-limiting valve 72 the output of which is in communication with the bore hole 46 is connected to the space 21, which is only shown diagrammatically. In the normal operation of a motor vehicle, the pressure-limiting valve 72 is set to a very low pressure so that the pump pumps only in rotation and is entrained by the internal combustion engine with low power. In braking operation, a high pressure in the region of, for instance, 100 bar is established by the pressure-limiting valve 72. An arcuate low pressure control groove 77 in the side of the second distributor disk 62 facing the front side part 13 is open inwards towards the annular groove 65. A high-pressure control groove 78 which is also arcuate but extends over a smaller angle is open outwards towards the space 21. The control grooves 77 and 78 are so arranged radially that they cover the axial bore holes 48. The distributor disk 62 is pressed by a sealing surface 79 against the second housing section 13, as a result of which the low pressure control groove 77 is sealed off outwards towards the space 21, the high pressure control groove is sealed off inwards towards the annular groove 65, and the two control grooves are sealed off from each other. The distributor disk 61 is pressed against the support ring by a sealing surface 80 which seals the cavity 69 off from the space 21. The distributor disk 62 therefore separates the hollow space 24 acted on by low pressure in the first housing section 21 from the hollow space 21 which can be acted on by high pressure between the two housing sections. Since the distributor disks 61 and 62 can move independently of each other in opposite directions, tolerances of structural parts and wear can be compensated for. The radial packings 64 also contribute to the separation of the zones acted on with different pressures.

The force which presses the two distributor disks 61 and 62 in opposite directions against the two housing sections 12 and 13 is produced in two different manners. On the one hand, compression springs 81 are inserted into the blind holes 67 of the distributor disk 61, they pressing the two distributor disks apart. On the other hand, a pressure surface 82 on the first distributor disk 61 is not pressure-equalized and a pressure surface 83 on the ring 63 is only partially pressure-equalized so that the two distributor disks are also pressed apart by the high pressure prevailing in the space 21. The force produced by this pressure by far predominates over the force produced by the springs 81, which merely have the function of pressing the distributor disks against the housing sections already when high pressure is absent.

In the zone of the high pressure control groove 78, the distributor disk 62 is acted on by high pressure in a direction away from the second housing section 13. In order to compensate for the force produced thereby which counteracts a tight application of the distributor disk 62 against the housing section 13, a small compensation piston 84 is arranged substantially axially behind the control groove 78 in a blind hole of the first distributor disk 61, which piston can be acted on by high pressure on its rear side facing away from the second distributor disk 62 via a radial bore hole 85 in the distributor disk 61. The high pressure in the pressure field between the compensation piston and the first distributor disk 61 acts on the second distributor disk in the direction towards the housing section 13 and on the first distributor disk 61 in the direction towards the support ring 70. In order that the distributor disk 61 not be pressed too strongly against the support 70 in the zone of the pressure field, it is provided on its side facing the support ring with a pocket 86 which is open radially outward to the space 21 and is formed by a radial indentation in the sealing surface 80 and separated from the hollow space 24 by the sealing surface 80.

The eccentric ring 43 is secured in the one direction by a stop disk 87 which is seated on the drive 37 on the one side of the eccentric 42. The stop disk 87, in its turn, is held by the feather key 59 on the eccentric 42. Therefore, additional means for the axial securing of the stop disk 87 are not necessary.

In order to smooth out pressure pulsations of high frequency which occur in the low-pressure zone of the pump, said low-pressure zone is connected with a low pressure pulsation damper 90 which includes a damping piston 91 of low mass which is developed as a hollow piston. The damping piston 91 is received in a blind hole 92 which is introduced into the first housing section 12 from the side facing the gear wheel 41 eccentrically to the drive shaft 37. The diameter of the bore hole 92 is slightly greater than the outside diameter of the damping piston 91. On the gear-wheel side, the damping piston 91 is acted on by a compression spring 93 which rests against a spring cup 95 provided with a central passage 94. The spring space is therefore relieved towards the oil pan of the internal combustion engine. On the front side of the damping piston, the hole 92 is connected with the hollow space 24 by an oblique bore hole 96.

When the internal combustion engine of a motor vehicle which is provided with an engine brake is operating, it drives the drive shaft 37 along with it via the gear wheel 41. The radial pistons 27 rest on the eccentric ring 43 and carry out their stroke movements. The distributor unit 60 is entrained by the drive shaft. In normal operation, when the engine brake is not used, the pressure-limiting valve 72 is set to a low pressure. The pump is driven along with low power. The distributor disks lie against the housing sections only on basis of the springs 81, so that they are driven along practically without power.

For the use of the engine brake, the pressure-limiting valve is set to a high pressure of, for instance, 100 bar. This pressure then prevails in the space 21 between the two housing sections 12 and 13. While the distributor unit 60 rotates, the axial bore holes 48 are now alternately connected via the control groove 77 with the low-pressure zone and via the control groove 78 with the high-pressure zone of the pump. During the connection with the high-pressure zone, the high pressure builds up in a control line, so that a decompression valve with which this control line is associated is opened by the corresponding actuating piston. After the separation of the bore hole 48 from the high-pressure zone and after its connection to the annular groove 65 belonging to the low-pressure zone, the actuating piston is relieved, so that the decompression valve again closes. Both in normal operation and in brake operation a given amount of oil flows through the bore hole 96, the annular slot between the damping piston 91 and the housing section 12 and through the spring cup 95 back to the oil supply pre-container. The annular slot acts in this connection as discharge choke. In brake operation, heat is removed from the pump by this stream of oil.

In the case of the distributor unit 60 shown in FIGS. 2 to 5, the outer ring 63 present in the embodiment of FIG. 1 is absent and the two distributor disks 61 and 62 are guided telescopically directly one within the other. In this connection, the first distributor disk 61 is contained in a cavity of the second distributor disk. Between the two distributor disks there is again a radial packing 64. The side of the distributor disk 62 facing a second housing section with the control outputs is developed substantially in the same manner as in the embodiment shown in FIG. 1. Its different surfaces can be clearly noted from FIG. 2. In it there can be noted the annular groove 65, the low-pressure control groove 77, the high-pressure control groove 78, and the sealing surface 79. Outside the sealing surface there is furthermore an annular surface 96 which is set back with respect to the sealing surface 79 and which corresponds to the side of the ring 63 of FIG. 1 which faces the second housing section 13. This annular surface 96 is acted on by high pressure in brake operation but is pressure equalized. The position of the control outputs 48 is indicated by the dot-dash circle in FIG. 2.

Figure 4:
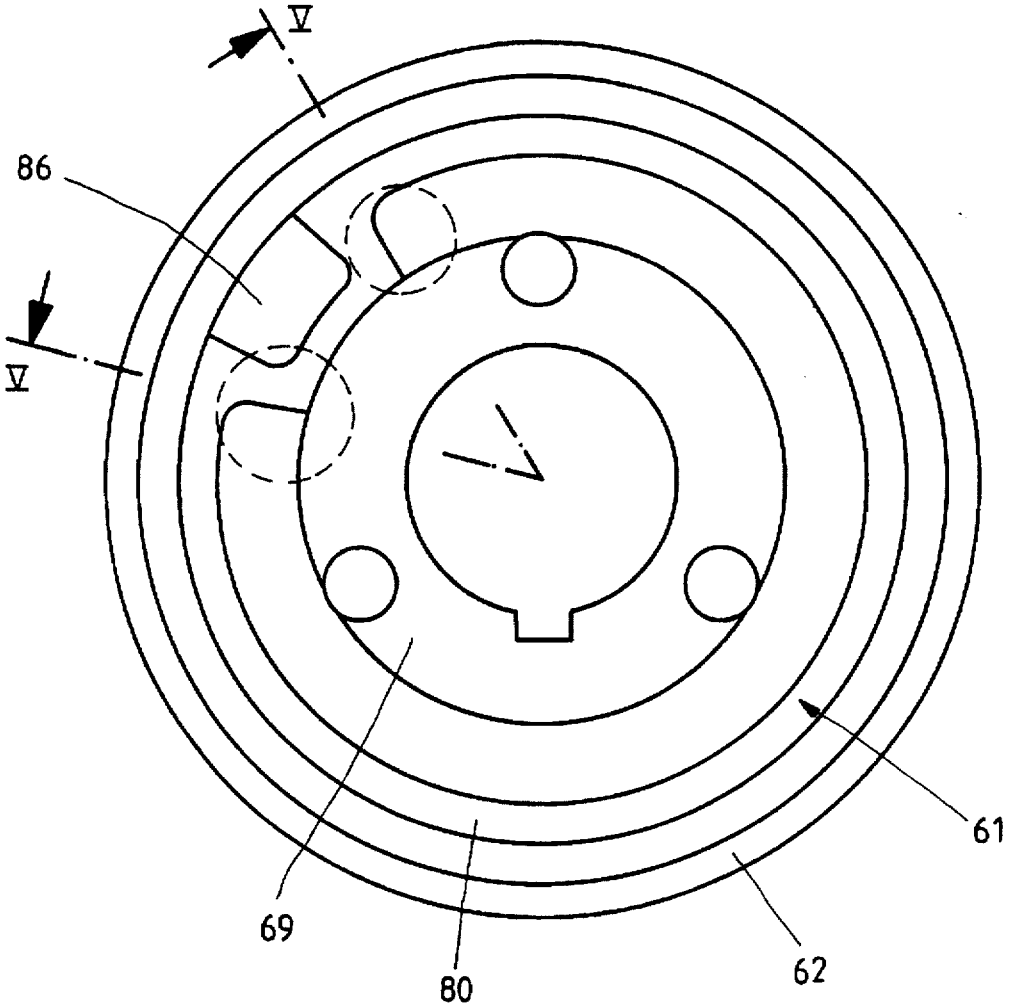
FIG. 4 is a top view of the front side of the first distributor disk of the second embodiment, facing away from the second distributor disk.
Figure 5:
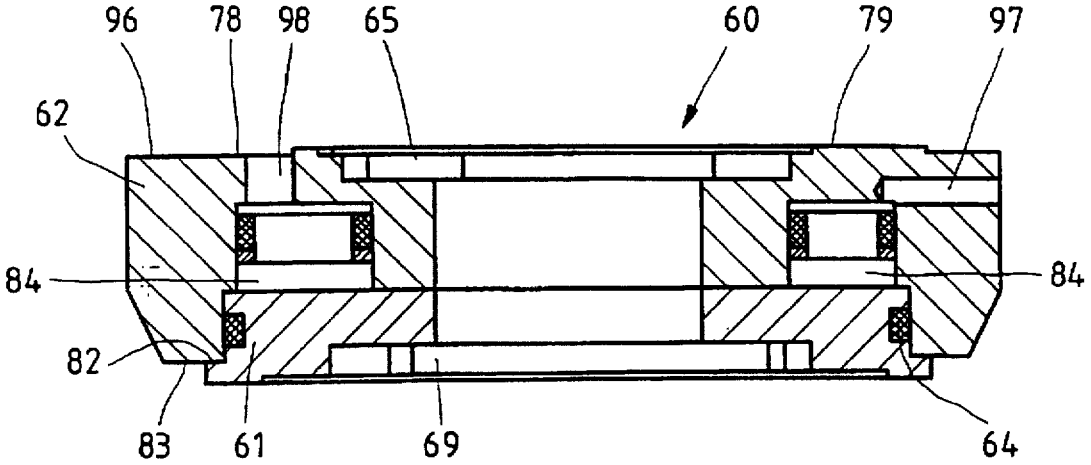
FIG. 5 is a cross section along the line V—V of FIG. 4.

The side of the first distributor disk 61 facing a first housing section 12 is also developed in a manner similar to the embodiment shown in FIG. 1. In FIG. 4 there can be noted the sealing surface 80, the pocket 86 which can be acted on by high pressure, and the central cavity 69 which, to be sure, differing from the embodiment in FIG. 1, becomes flatter in one step towards the sealing surface 80 so as to protect the dimensional stability of the distributor disk 61.

In the embodiment shown in FIGS. 2 to 5, the second distributor disk 62 is substantially thicker axially than the first distributor disk 61. Therefore, the blind holes 67 for the reception of the compression springs 81 are now located in the second distributor disk 62. Each blind hole 67 is at the same time part of a passage between the annular groove on the front of the one distributor disk and the cavity 69 on the opposite side of the other distributor disk. The passage includes, furthermore, as in FIG. 1, a bore hole 68 at the bottom of the blind hole 67 and a bore hole 66 in the first distributor disk 61. In order to compensate for the force produced by the high pressure in the high-pressure control groove 78 and acting on the distributor disk 62, two compensation pistons 84 are now provided which are at a slight peripheral distance from each other and which are now received by blind holes in the distributor disk 62. The compensation pistons 84 furthermore rest via their one face against the distributor disk 61 while, between their other face and the bottom of the corresponding blind hole there is present as pressure field a free space which is connected with the high-pressure zone of the pump. This connection is produced for the one compensation piston 84 by a radial bore hole 97 in the distributor disk 62. For the other compensation piston 84 an axial bore hole 98 extending from the high-pressure control groove serves for producing the connection. For the pressure compensation, it has been found favorable, with due consideration of the position of the compensation pistons 84, to make the cross section of the compensation pistons and thus the pressure fields of different size. The side 83 of the distributor disk 62 which can be acted on by the high pressure is greater than the annular surface 96 so that it is not pressure-equalized and, with high pressure prevailing a hydraulically produced force acts on the second distributor disk 62 in the direction towards a second housing section 13. On the first distributor disk 61, the surface 82 with which the distributor disk 61 can lie on the side 83 of the distributor disk 62 is not pressure-equalized, so that, with high pressure prevailing, a force acts in the opposite direction on the distributor disk 61.

Figure 6:
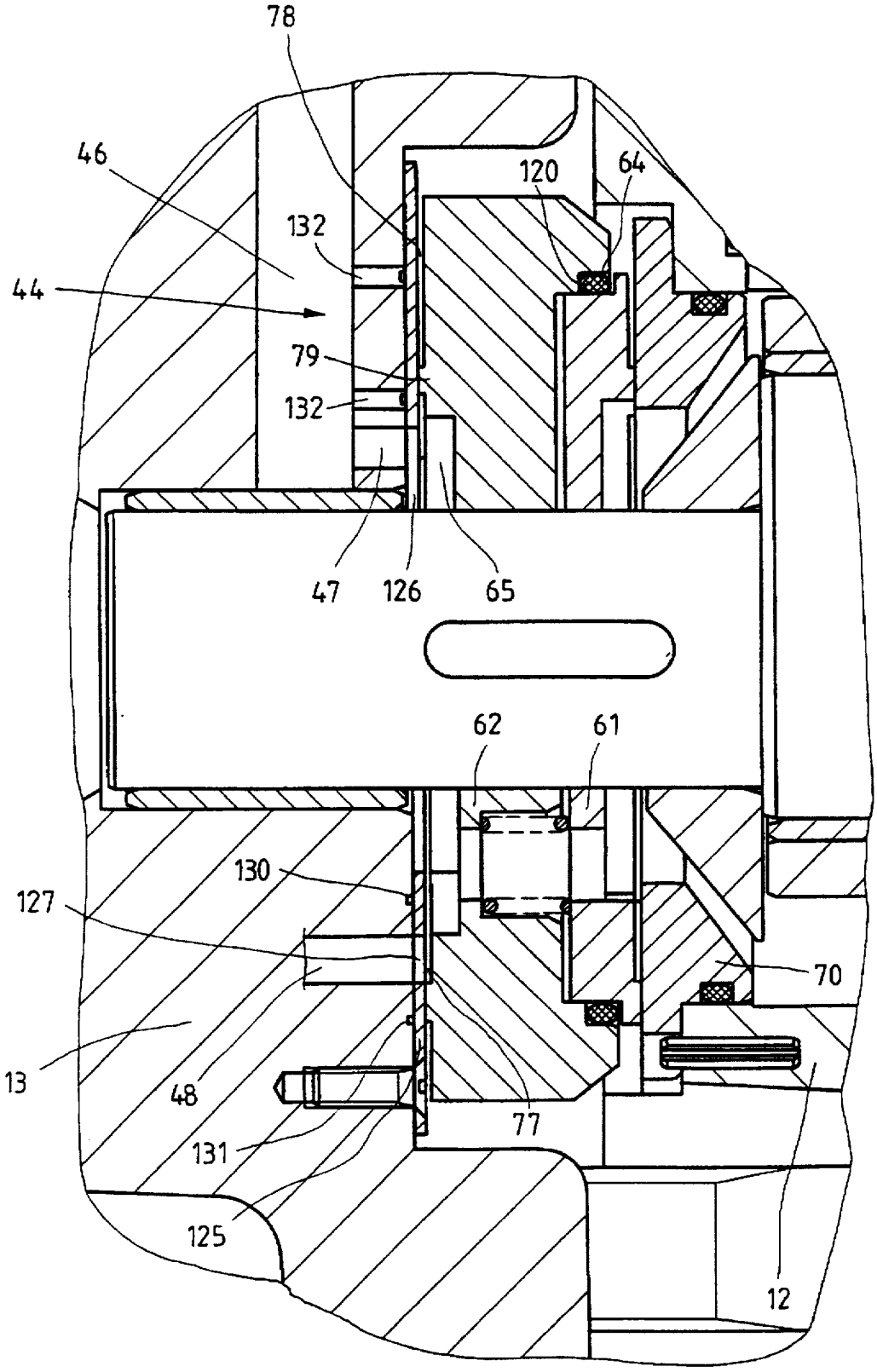
FIG. 6 is a partial section axially through a third embodiment in the region of the distributor disks.

The distributor unit 60 of the embodiment of FIG. 6 corresponds, with respect to the shape of the distributor disks 61 and 62, substantially to the distributor unit of FIGS. 2 to 5. One difference is that the radial packing 64 between the two distributor disks 61 and 62 is located in a milling 120 axially open on one side provided in the one distributor disk, namely the distributor disk 62. The distributor disk 61 covers the milling 120 radially, so that the radial seal is secured in unlosable manner. Due to such a development, the distance over which the two distributor disks 61 and 62 are guided one within the other can be shortened as compared with the embodiment of FIGS. 2 to 5 in order also to reduce the axial length of the two distributor disks.

The space gained in used in order to arrange a disk 125 of a hardened steel plate between the housing section 13 and the distributor disk 62. This disk is fastened, fixed against rotation, on the housing section 13 and is provided with a central opening 126 and with bore holes 127 which lie precisely opposite the bore holes 48 in the housing section 13 so as to produce the connection between the bore holes 46 and 47 of the low-pressure feed channel 44 and the annular groove 65 and to permit the alternate connecting of the control outputs 48 with the low-pressure control groove 77 and high-pressure control groove 78 of the distributor disk 62.

In the housing section 13, there are two circular pressure relieve grooves 130 and 131 which are open towards the disk 125, one being arranged radially outside the control outputs 42 and the other radially inside the control outputs 48. Each pressure relief groove is connected via an axial bore hole 132 in the housing section 13 with the bore hole 46 and therefore with low pressure. By the pressure relief grooves 130 and 131, the pressure force which seeks to lift the disk 125 off from the housing section 13 despite its attachment is reduced.

The distributor disk 62 is made of bronze and is pressed by its sealing web 79 against the steel disk 125. The distributor disk 61 also consists of bronze and lies against the support ring 70 which is made of steel. Good wear behavior is obtained as a result of these pairings of material.

Figure 7:
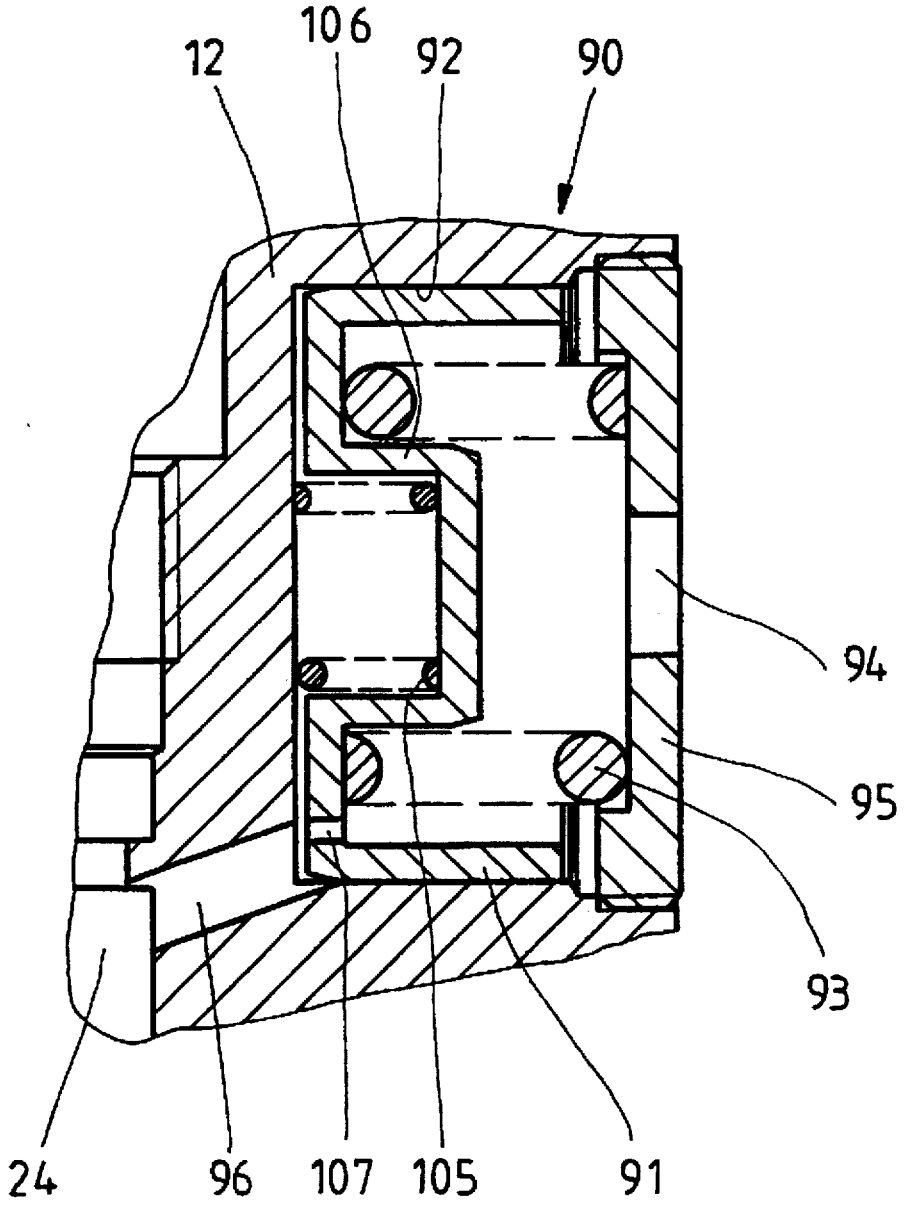
FIG. 7 shows a portion of a fourth embodiment in the region of its low pressure pulsation damper, the damping piston of which is acted on, in opposition to the low pressure, by a strong compression spring and together with the low pressure by a weak compression spring.

The low-pressure accumulator 90 of FIG. 7 is arranged at the same place in a first housing section 12 and connected via a bore hole 96 with a hollow space 24, as the low pressure accumulator of FIG. 1. It also has a damping piston 91 which is developed as hollow piston. A spring retainer, having a central passage 94 is screwed into the blind hole 92. There are essentially two differences from the low-pressure pulsation damper of FIG. 1. On the one hand, a second pressure spring, which, however, has a substantially smaller spring constant than the compression spring 93, acts on the damping piston 91 with the low pressure against the force of the compression spring 93. For the damping piston 91 there is not provided, as in the case of that of FIG. 1, elevated over the bottom of the guide hole 92, a stop against which it can be pressed by the compression spring 93. Rather, the damping piston 91 of FIG. 7 is held by the weak, second compression spring 105 at all times against the strong compression spring 93 regardless of the tolerances in the dimensions of the individual structural parts. The level at which the equilibrium of forces exists between the two compression springs 93 and 105 is, in this connection, only slightly affected by the tolerances, since the force exerted by the weak compression spring 105 changes only slightly with the distance due to the small spring constant. In order that the compression spring 105 does not take up additional space in the housing section 12, the damping piston 91 has centrally a cup-shaped indentation 106 which is open toward the low pressure side, extends into the inside of the compression spring 93, and is therefore surrounded by said compression spring, and within which the compression spring 105 is arranged.

The second difference concerns the discharge choke in the scavenging oil line which leads, also in the embodiment of FIG. 7, through the low pressure pulsation damper. The discharge choke, to be sure, is now a bore hole 107 in the bottom of the damping piston 91 through which the space having the compression spring 93 present behind the damping piston 91 is connected with the space in front of the damping piston 91.

Figure 8:
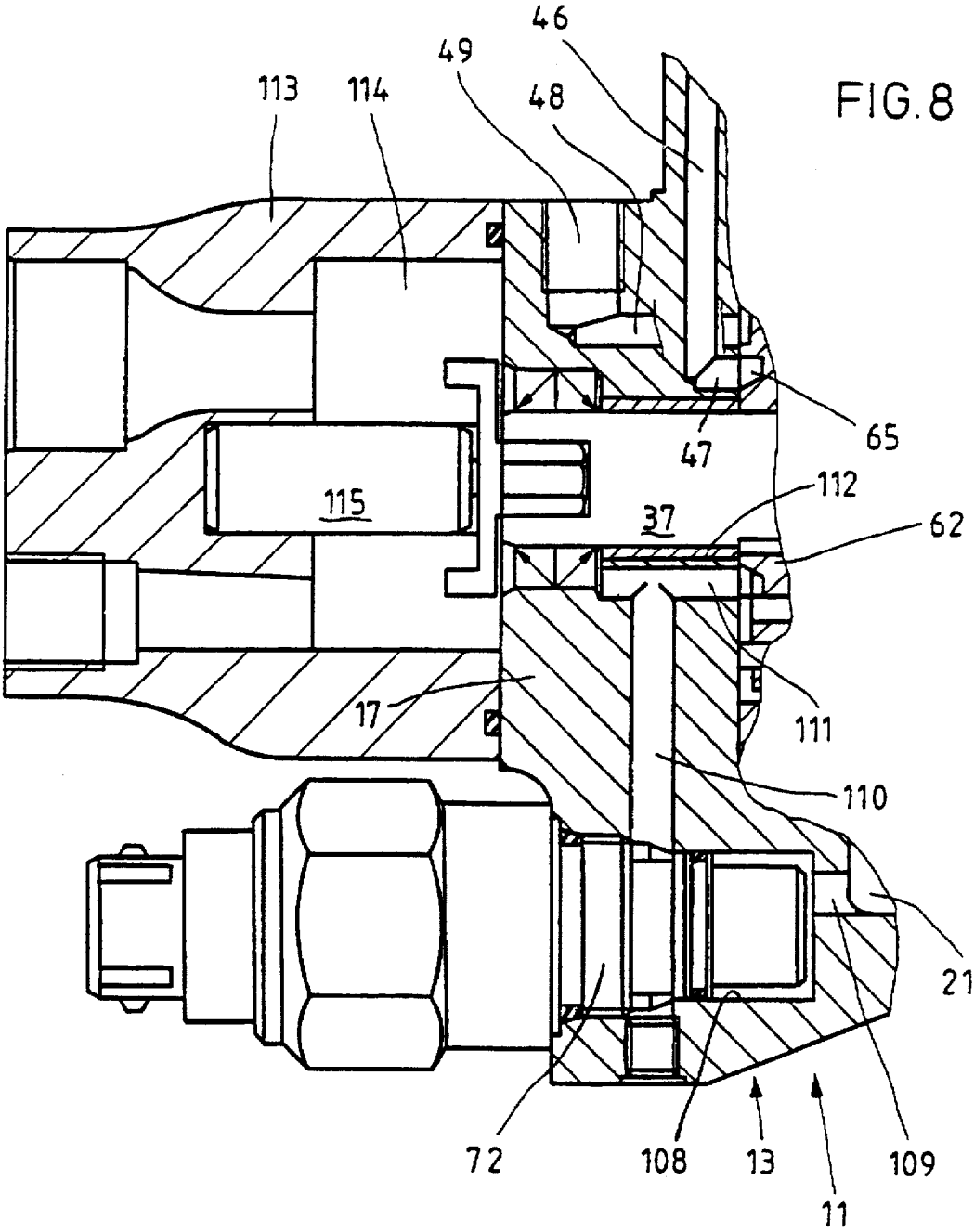
FIG. 8 is a portion of a fifth embodiment in which a fuel pump present on the pump housing of the engine brake can be driven via the drive shaft.

If, in the case of a radial piston pump for an engine brake, the radial pistons are supported in accordance with the invention internally on an eccentric rotating with a drive shaft, the drive shaft can in simple manner be developed as continuous drive, with which some other secondary attachment of a motor vehicle can be driven. This has been done in the embodiment shown in FIG. 8. In that figure there can be noted a second housing section 13 of the housing 11 of a radial piston pump forming part of an engine brake. This housing section 13 is developed similar to the housing section 13 of FIG. 1. It has a bore hole 46 of a low-pressure feed channel which extends with an axial bore hole 47 from the inside of the bottom 17 of the housing section 13. The axial hole 47 is opposite an annular groove 65 in the second distributor disk 62. Into an axial blind hole 108 which is connected via a bore hole 109 in its bottom with the space 21 which be acted on by high pressure, the pressure-limiting valve 22 is inserted, its discharge side being connected two bore holes 110 and 111 with the annular groove 65. The control connections 49 now extend radially from the housing section 13 and can be connected, as in FIG. 1, via axial bore holes 48 with the high-pressure zone or the low-pressure zone of the pump.

Instead of a blind hole, the housing section 13 is provided with a passage bore hole 112 for the mounting of the drive shaft 37. On the housing section 13, there is attached a fuel pump 113 which is developed as internal gear pump and its rotor 114 rotatably mounted on a journal 115, is coupled with the drive shaft 37 and can be driven via the latter by the internal combustion engine.

We claim:

1. An engine brake for a multi-cylinder internal combustion engine with decompression valves which can be actuated by the pressurizing of hydraulic pistons outside the exhaust stroke of the work pistons, particularly at the end of the compression stroke, having a radial piston pump (10), which has a pump housing (11), a drive shaft (37) drivable with a speed of rotation coupled with the speed of rotation of the internal combustion engine, at least one radial piston (27) controllable by an eccentric element (42), a distributor unit (80) which is coupled, locked for rotation, with the drive shaft (37), and control outputs (48) for the pressurizing and depressurizing of the hydraulic pistons of the decompression valves which lie axially opposite the distributor unit (60) and can be connected alternately via the distributor unit (60) with a high-pressure zone (21) and a low-pressure zone (24) of the radial piston pump (10), the improvement wherein said at least one radial piston (27) is arranged in the pump housing (10) and is internally radially supported on an eccentric (42) which can be driven from the drive shaft (37); that the pump housing (10) has a first housing section (12) with said at least one radial piston (27) and a space (24) for the eccentric (42) and a second housing section (13) having the control outputs (48); and that the distributor unit (60) has two distributor disks (61, 62) which are displaceable sealed off axially with respect to each other, of which the first distributor disk (61) which separates a first pressure zone (24) within the first housing section (12) from a second pressure zone (21) between the two housing sections (12, 13) from each other is adapted to be pressed axially against the first housing section (12), and the second distributor disk (62) which connects a control output (48) with the one pressure zone (24) or the other pressure zone (21), is adapted to be pressed axially against the second housing section (13).

2. An engine brake according to claim 1, wherein the first distributor disk (61) can be pressed in the one axial direction against the first housing section (12) and the second distributor disk (62) can be pressed in the opposite axial direction against the second housing section (13).

3. An engine brake according to claim 1, wherein the first pressure zone (24) is the low-pressure zone and the second pressure zone (21) is the high-pressure zone.

4. An engine brake according to claim 2, wherein the two distributor disks (61, 62) are guided telescopically in one another or in a third part (63), and that a radial packing ring (64) is arranged between two parts (61, 63; 62, 63) which are guided telescopically one within the other.

5. An engine brake according to claim 4, wherein the radial packing ring (64) is contained in a unilaterally axially open milling in the one part (64) which is covered radially by another part (61).

6. An engine brake according to claim 2, wherein the distributor disks (61, 62) can be pressed by the high pressure hydraulically apart from each other towards the first housing section (12) or the second housing section (13).

7. An engine brake according to claim 6, wherein each distributor disk (61, 62) has associated with it an at least partially pressure non-compensated outer shoulder (83, 82) which faces the other distributor disk (62, 61) and is accessible from the second pressure zone which can be acted on by high pressure.

8. An engine brake according to claim 6, wherein that the active pressure surface on the one distributor disk (62) is greater than on the other distributor disk (61).

9. An engine brake according to claim 6, wherein at least one spring element (81) and preferably several spring elements (81) having the same angular distance from each other are arranged between the two distributor disks (61, 62), pressing them axially apart.

10. An engine brake according to claim 1, wherein the second distributor disk (62) has a low pressure control groove (77) and a high pressure control groove (78) in its end surface facing the control outputs (48) via which grooves the control outputs (48) can be connected with the high-pressure zone (21) and the low-pressure zone (24); and that a pressure field which can be acted on by high pressure is present in the zone axially behind the high pressure control groove (78) on the other side of the second distributor disk (62).

11. An engine brake according to claim 10, wherein the pressure field can be acted on by high pressure via a bore hole (85, 97, 98) or a groove in the second distributor disk (62), in particular, via the high-pressure control groove (78).

12. An engine brake according to claim 10, wherein the first distributor disk (61) can be acted on in the direction towards the first housing section (12) by a pressure in the pressure field, and that this action can be compensated for by a pressure field (82) on the side of the first distributor disk (61) facing the first housing section (12).

13. An engine brake according to claim 1, wherein the first pressure zone (24) is connected via in each case at least one passage (66, 67, 68) in each distributor disk (620 with a cavity (65) on the side of the second distributor disk (62) facing the control outputs (48).

14. An engine brake according to claim 13, further comprising a spring element (81) which presses the two distributor disks (61, 62) apart is contained in a blind hole (67) of a distributor disk (61, 62), and that an opening (68) is present, as part of the passage of this distributor disk (61, 62), in the bottom of the blind hole (67).

15. An engine brake according to claim 13, wherein a low-pressure feed channel 44 leading through the second housing section (13) is continuously connected with the cavity (65) in the second distributor disk (62) which cavity is connected with the first pressure zone (24).

16. An engine brake according to claim 1, wherein the distributor disks (61, 62) are made of a steel and are provided with a slide coating at least on the portions of the surface on which they lie on the housing sections (12, 13).

17. An engine brake according to claim 1, wherein the distributor disks (61, 62) are made of a plain-bearing material, in particular bronze, and can be pressed against a steel inset (70, 120) held on the corresponding housing section (12, 13).

18. An engine brake according to claim 17, wherein between a steel plate held on the second housing section (13) and a steel plate held on the latter there are present at least one pressure relief groove, and preferably two pressure relief grooves (130, 131) one being present radially within the control outputs (48) and one radially outside the control outputs (48).

19. An engine brake according to claim 18, wherein a pressure relief groove (130, 131) is connected with the low-pressure feed channel (44) via a bore hole (132 in the second housing section (13).

20. An engine brake according to claim 1, wherein the distributor unit (60) is fastened, secured for rotation, with the drive shaft (37) via a feather key (59); that an eccentric ring (43) is rotatably mounted on an eccentric portion (42) of the drive shaft (37); that a stop disk (87) for the axial supporting of the eccentric ring (43) is arranged laterally of the eccentric portion (42) on the drive shaft (37); and that the stop disk (87) is axially secured by the feather key (59) on the side facing away from the eccentric portion (42).

21. An engine brake according to claim 3, wherein the second distributor disk (62) has in the side facing the second housing section (13) radially inward an annular groove (65) which is located axially opposite an axial outlet opening (47) present further radially inward than the control outputs (48) of a low-pressure feed channel (44) extending in the second housing section (13) and is connected with the first pressure zone (24); that in the same side of the second distributor disk (62) radially outside the annular groove (65) and opposite the control outputs (48) there are an arcuate low-pressure control groove (77) which is open radially inwards to the annular groove (65) and closed radially outwards to the second pressure zone (41) and an arcuate high-pressure control groove (78) which is open radially outward to the second pressure zone (21) and closed to the annular groove (65) and the low-pressure control groove (77).

22. An engine brake according to claim 1, wherein the first housing section (12) has a cup-like hollow space closed by a bottom (16) at the end remote from the bottom (17) of the cup-like second housing section (13), within which hollow space the eccentric element (42) is located; that the drive shaft (37) is mounted on the one side of the eccentric element (42) with a first bearing section (38) within the first housing section (12) and is mounted on the other side of the eccentric element (42) via a second bearing section (39) in the second housing section (13), and that the distributor unit (60) is arranged between the eccentric element (42) and the second bearing section (39) of the drive shaft on the latter.

23. An engine brake according to claim 1, wherein the first housing section (12) extends into the second housing section (13) of cup-like development, rests via an outer flange (19) on a substantially annular side (20) of the second housing section (13), and is centered via a centering collar (18) adjoining the outer flange (19) on the inner side on the second housing section (13); and that there is a distance between the two housing sections (12, 13) at all places axially further inward than the centering collar (18).

* * * * *